US005762059A

United States Patent [19]

Strope

[11] Patent Number: 5,762,059

[45] Date of Patent: Jun. 9, 1998

[54] ARCHERY BOWSTRING MOUNTED OPEN-NOTCH PEEP SIGHT

[76] Inventor: Roger D. Strope, 6615 Rock Haven La., Jefferson City, Mo. 65101

[21] Appl. No.: 547,992

[22] Filed: Oct. 25, 1995

[51] Int. Cl.[6] ..... F41G 1/467

[52] U.S. Cl. ..... 124/87; 124/90; 33/265

[58] Field of Search ..... 33/265; 124/87, 124/90, 91, 92

[56] References Cited

U.S. PATENT DOCUMENTS

| | | | |
|---|---|---|---|
| D. 226,429 | 3/1973 | Christen | D22/107 |
| D. 351,209 | 10/1994 | Saunders | D22/107 |
| 4,454,857 | 6/1984 | Miller et al. | 124/87 |
| 4,860,458 | 8/1989 | Ernstsen | 33/265 |
| 5,016,603 | 5/1991 | Tentler | 124/91 |
| 5,056,498 | 10/1991 | Scherz | 124/87 |
| 5,287,842 | 2/1994 | Saunders | 124/91 |
| 5,325,598 | 7/1994 | Hall et al. | 33/265 |
| 5,347,976 | 9/1994 | Saunders | 124/87 |
| 5,450,673 | 9/1995 | Denton | 33/265 |

*Primary Examiner*—John A. Ricci

[57] ABSTRACT

An archery bowstring mounted open notch peep sight apparatus comprising a hollow cylinder having two disc-shaped pieces, one attached to either end of the cylinder, forming one unit, and which has a hollow channel running lengthwise through the center of the peep sight which may receive the tightly fitting bowstring so that the peep sight apparatus may be mounted on the bowstring. In a preferred form the peep sight has a slot extending along its length, to allow the bowstring to pass through so that the peep sight may be easily mounted on a bowstring, even while the bowstring is strung on a bow. When the bow is drawn back the peep sight is thereby tilted along the angle of the drawn bowstring so that in the archer's line of sight the two discs of the peep sight appear to partially overlap in such a manner so that visual notches appear on the right and the left of the point where the discs of the peep sight visually overlap. Either notch may be used at the preference of the archer as the sighting aperture, which sighting apertures are free of any physical obstructions to the archer's line of sight through the sighting aperture. Any rotation that may occur to the peep sight due to the twisting of the bowstring as it is drawn does not affect the archer's view through the sighting aperture.

3 Claims, 1 Drawing Sheet

ARCHERY BOWSTRING MOUNTED OPEN-NOTCH PEEP SIGHT

BACKGROUND OF THE INVENTION

1) Field of the Invention

The present invention generally relates to sporting equipment and more particularly is concerned with archery aids in the form of bowstring mounted peep sights which are used by an archer to aim the arrow at the desired target.

2) Prior Art

The prior art consists of various of devices whose purpose is to aid in archery sighting. One such type of device developed and used is peep sights which assist the archer in improving the accuracy of the archer's aim of the arrow. Certain of the peep sights are designed to be affixed temporarily or semi-permanently on the bowstring of the archery bow. When the bow is positioned at a target, and while the archer has the bowstring drawn and is aiming the path of the arrow, the drawing of the bowstring re-positions the peep sight mounted on the bowstring so that the peep sight is in a position to be aligned by the archer in the archer's line of sight while sighting through the sighting aperture of the peep sight, with a sighting pin or similar device that is fixed on the bow, and with the chosen target.

Examples of devices of this type are disclosed in U.S. Pat. No. 5,056,498 to Scherz issued Oct. 15, 1991, U.S. Pat. No. 4,454,857 to Miller et al issued Jun. 19, 1984, and U.S. Pat. No. 5,080,084 to Kendall et al issued Jan. 14, 1992. Another example of peep sight is U.S. Pat. No. 4,454,857 to Miller et al describing a type of bowstring mounted peep sight having radial spokes extending from a hub of the sight to an outer rim of the sight.

Drawbacks of certain of the prior art are the obstructions to the archer's line of sight inherent in their design and use. These obstructions occur in several forms and result from various particular characteristics of prior art devices.

Certain prior bowstring mounted peep sights also presented difficulties in their use as a result of obstruction of the archer's line of sight due to the displacement of the peep sight's sighting aperture in the event the bowstring twisted when drawn by the archer. In such prior art peep sights, the sighting aperture might become obstructed in part, or even completely, by the rotation of the peep sight that occurs when the bowstring upon which it is mounted twists as the bowstring is being drawn back prior to the shooting of the bow, causing misalignment of the peep sight and sighting aperture, which might render the use of the peep sight difficult, or prevent its use altogether. Some of the prior art has instructed use of a peep sight turner or other devices designed to readjust the rotated sight after it had rotated with the drawing of the bow. Such devices frequently prove cumbersome in actual use, and also inconveniently require the installation of the additional device.

Furthermore the design of certain prior art peep sight devices are such that they are easily obstructed by dirt and water. Many of the prior art peep sights have a relatively small opening or openings to serve as the sighting aperture. This trait, particularly when combined with a completely enclosed design of the sighting aperture that is bounded upon all sides by the body of the peep sight, especially inclines the peep sight device to become obstructed by dirt and water. This problem is compounded in sighting devices which have an aiming point or pin placed inside the sighting aperture. Small openings for sighting apertures such as appeared in the prior art also presented the difficulty of tracking a moving target by the archer while aiming.

Other prior art devices presented a similar problem of physical obstructions to the view through the sighting aperture, resulting from the bowstring passing through the sighting aperture of the sight. Some devices were designed in such a manner that their method of attachment to the bowstring required the separating of the strands of a segment of the bowstring at the point of mounting so that the strands pass through the outer rims or through spokes of the peep sight at such points on the device that are designed for the placing of such strands, and not, as with other peep sight designs, as one unseparated strand through a central point in the sight. In actual practice these separated strands, although not completely obstructing the sighting view, tend to impede the archer's view. Additionally, peep sights which require the separation of the stands of the bowstring present a time-consuming and tedious method of installation, typically requiring the dismantling of the bowstring from the bow in order for the peep sight to be mounted in place, and further requiring the separating of the bowstring strands. Other designs of peep sights in the prior art which did not require separation of the bowstring into strand still also required the peep sight to be mounted on the bowstring while the bowstring was unstrung.

Furthermore certain prior art devices are constructed in such a fashion that portions of the archer's view when sighting through the sight may be obstructed by part of the body of the peep sight itself which protrudes into or through the sighting aperture or otherwise through the archer's line of sight.

As a result a need exists for improvements in archery peep sights, and particularly bow mounted peep sights, that will assist the archer in obtaining greater accuracy by reducing obstructions to and impairment of the archer's view through the sighting aperture of the peep sight while at the same time will not rotate out of alignment and will not require the adjustment of the peep sight during the process of aiming, that will provide ease of aiming, and that may be conveniently mounted on the bowstring without requiring the separation of the strands of the bowstring.

BRIEF DESCRIPTION OF THE DRAWINGS

In FIG. 3 also appears a side view of a nocking band such as may fit around the cylinder of the peep sight as desired to secure the peep sight in place when mounted on the bowstring.

Figure 5:
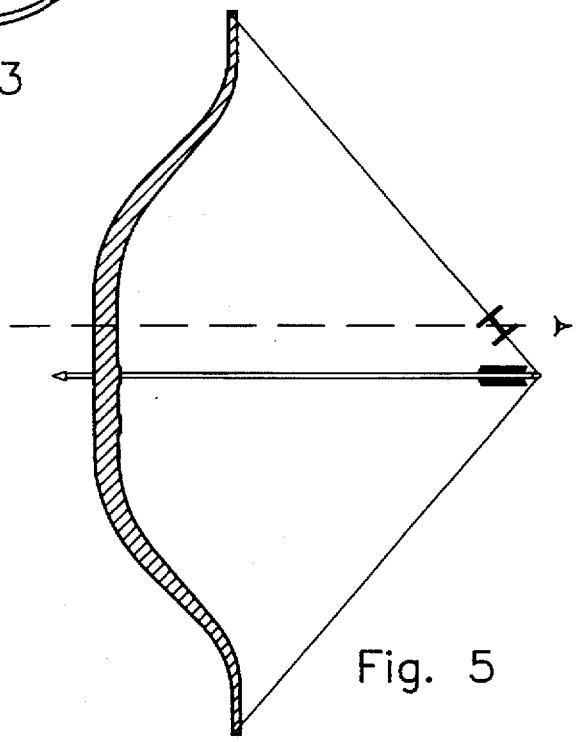

The drawing in FIG. 5 illustrates a drawn bow with the invention mounted on its bowstring.

SUMMARY OF THE INVENTION

The present bowstring mounted peep sight generally alleviates the aforementioned problems and drawbacks, and provides an improved means of assisting the archer in the sighting of a bow by providing minimal obstruction to the view of the archer through the sight and of the sighted target, the design of the present peep sight is such that it avoids the rotation problems encountered by certain other peep sights, the present peep sight does not require separation of the strands of the bowstring, and this invention, in its preferred form, can be mounted for use on the bowstring without requiring the disassembling of the bow. Furthermore, since the sighting aperture is open on one side, and since the sighting aperture is a somewhat larger opening than in certain other peep sights, the present peep sight and in particular its sighting aperture, are not easily obstructed by dirt and water. The peep sight may be used for sighting the target even if the sight has rotated to any degree with any twisting that may occur in the bowstring as it is drawn. The peep sight does not require a device commonly referred to as a peep sight turner to readjust the peep sight for any rotation to the peep sight that may have occurred due to the twisting of the bowstring when drawn. The present invention also does not require the separation of strands of the bowstring at the point of mounting. The preferred embodiment of the present invention does not require dismantling the bowstring from the bow to mount the peep sight in place.

The present invention comprises a peep sight in the form of a cylinder having two thin discs attached perpendicularly to the cylinder, with one disc on each end of the cylinder. The cylinder of the peep sight is hollow, and each disc mounted on each end of the cylinder has a hole in its center that corresponds roughly in size and in location to the hole on either end of the cylinder where the hollow core of the cylinder reaches each end of the cylinder, so that the entire peep sight has a hollow channel extending through its center and out through each end through a hole in the center of the disc. A preferred form has a lengthwise slit down one side forming a slot that enables the bowstring to be slid through the slot and into the hollow center of the peep sight which hollow center is of a circumference so as to tightly receive the bowstring.

The manner and process by which the peep sight device generally operates is that the peep sight is ideally to be mounted on the bowstring above the nocking point in the bowstring. This will generally situate the peep sight at the locus of the archer's line of sight. When the peep sight is mounted on the bowstring, it may be further secured in place with a nocking band placed around the cylinder to tighten the cylinder around the bowstring. Once the peep sight is mounted on the bowstring, and when the bowstring is drawn, the channel of space between the two planes of the discs of the sight moves to near horizontal, and the two sighting apertures of the peep sight appear as notches formed where the two discs appear in the archer's line of sight to partially overlap, one notch appearing to the left side and one appearing to the right side of the peep sight. Either sighting aperture may be used at the archer's preference. The aperture chosen by the archer may be used to sight the target by visually aligning the target with a sighting pin mounted on the bow. The sighting apertures do not present any obstructions through the space of their openings which might impair the archer's target sighting.

An object of this invention is to provide a new, improved archery peep sight for mounting on the bowstring of a bow which assists the archer in sighting the chosen target; and provides a sighting aperture free of visual obstructions, including visual obstructions to the sighting aperture in the event of misalignment due to the rotation of the peep sight as a result of the twisting of the bowstring when the bowstring is drawn; and that does not require use of a peep sight turner or other method of adjustment to realign the peep sight due to misalignment as a result of the twisting of the bowstring after the bowstring is drawn; which has less visual obstruction of the target and surrounding area due to the border of the sighting aperture itself; and which sighting apertures are not easily obstructed by dirt or water.

Another object is to provide a peep sight apparatus simple in its operation and installation, which does not require the separation of the strands of bowstring in its installation, which provides a line of sight for the archer that is easy and quick to aim, and in its preferred form does not require dismantling of the bowstring from the bow in order to mount the peep sight in position for use.

Further objects and advantages of this invention will appear from the following description taken in connection with the accompanying drawings which present through illustration and example, certain embodiments of this invention. The accompanying drawings constitute a part of this specification.

DETAILED DESCRIPTION OF A PREFERRED FORM OF THE INVENTION

Figure 3:
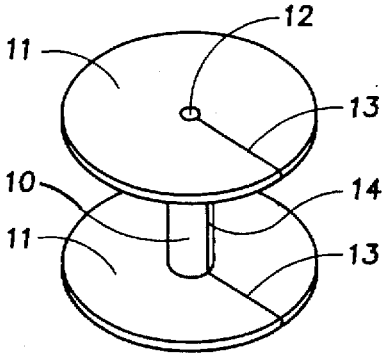
FIG. 3 shows the peep sight apparatus in a preferred embodiment having the full-length slot through which may pass the bowstring in a side view.
Figure 4:
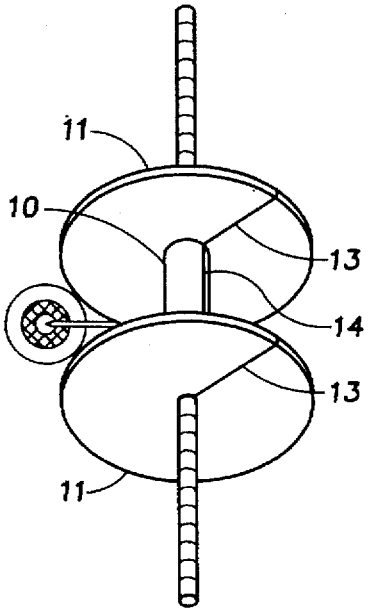
FIGS. 4 and 5 are drawings suggesting the operation of the bowstring mounted peep sight that is this invention. The drawing in FIG. 4 shows a rear view of the peep sight apparatus when mounted on a bowstring, and also illustrates how the notch is used to align with the target.

Referring to the drawings, and in particular to FIG. 4, a peep sight in accordance with this invention is mounted on the bowstring that has been strung on a conventional archery bow. The peep sight may be used with various types of archery bows and thus the archery bowstring and target illustrated in FIG. 4, and the archery bow illustrated in FIG. 5, are not to be considered the basis of any patentable features of the present invention; nor is the nocking band itself as appears in FIG. 3 to be considered the basis of any patentable features of the present invention.

Figure 1:
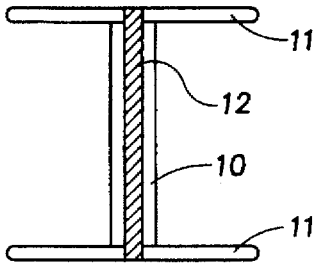
FIG. 1 shows the peep sight apparatus in side view with the peep sight in a vertical position as it would appear when mounted on the bowstring when the bow is held in an upright position.
Figure 2:
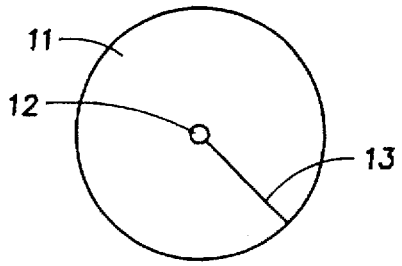
FIG. 2 shows a view of one of the discs of the peep sight at an angle showing the flat surface of the disc.

As shown in FIGS. 1 and 3, the peep sight comprises a cylindrical body 10 having two discs 11 attached to it, one at either end of the cylinder, with a flat surface of each disc abutting an end of the cylinder so that the discs on either end of the cylinder are approximately parallel to each other and at an approximate right angle to the cylinder. The discs are of a larger circumference than the cylinder, having a diameter approximately equal to the length of the cylinder. The cylinder is hollow (FIG. 1), and the discs on each end of the cylinder each have a hole through their centers (FIGS. 2, 3), which holes are also aligned with the hollow part of the cylinder's ends (FIG. 3), forming a hollow channel lengthwise through the peep sight and extending out through each end of the peep sight 12, thereby adapting to receive a bowstring.

It is a common practice in the field of archery to mark a point on the bowstring where the nock of the arrow is placed when shooting, called the nocking point. The peep sight is optimally mounted on the bowstring at a point shortly above the nocking point.

A preferred embodiment of the peep sight has a slot 13 formed into each disc along each disc's radius extending fully through the body of the disc as best seen in FIG. 2, and as also shown in FIGS. 3, 4. The slots in each disc are parallel to each other (FIG. 3), and are conjoined with a similar slot extending down the length of the side of the cylinder 14 in such a way that the end of the slot in each disc that is nearest the center of the disc is flush with an end of the slot in the cylinder as best seen in FIG. 3, but which is also shown in FIG. 4. The slot in the cylinder extends from the outer surface of the cylinder and fully through one side of the cylinder wall and conjoins with the hollow center of the cylinder. The slot is of a width such as may be spread to receive the bowstring, and the peep sight may be installed onto the bowstring by sliding the bowstring through the slot and into the hollow center of the peep sight. This may be done while the bowstring is strung on the bow or while unstrung. The peep sight may be secured more firmly in place on the bowstring by clamping an archery accessory known as a nocking band (see band in FIG. 3) around the cylinder of the peep sight. The peep sight may be equipped with the slot by methods other than forming the slot into the peep sight when the peep sight or any components of the peep sight are formed, but the peep sight may also be provided with the slot through other available and suitable means, such as by cutting.

The peep sight as seen in FIGS. 4, 5 is tilted from a plane of vertical to along the angle of the drawn bowstring. When in such tilted position, the archer views the archer's line of sight through one of two notch areas that appear to either side of the peep sight when the angle of the peep sight mounted upon the drawn bowstring causes the two discs of the peep sight to appear in the archer's line of sight to partially overlap. The archer then views through the notch selected by the archer (FIGS. 4, 5) and aligns the notch with a pin type sight, a common archery accessory, that is mounted on the bow above the arrow. The drawing in FIG. 4 shows a view such as would be seen by the archer while the bowstring is being drawn with the visual notches that appear on either side of the peep sight which serve as the sighting apertures. The drawings in FIGS. 4, 5 illustrate the line of sight of the archer through a sighting aperture of the peep sight.

In its presently preferred form the peep sight is formed out of a resilient, flexible material, into one contiguous unit having the components described herein. However, other suitable materials may be used to fabricate the peep sight, and the peep sight may be formed other than as one contiguous unit, with component parts which may be assembled together into the whole.

Besides the described embodiments of the peep sight disclosed herein other constructions, forms, modifications and arrangements of the components thereof will occur to those skilled in the art without departing from the spirit and scope of the invention or losing all of its material advantages. The description above of the invention in a preferred form and the embodiments disclosed therein are not to be interpreted as limiting, but as illustrative of the scope of the invention that appears in the claims appended hereto.

I claim:

1. An archery bow peep sight apparatus, comprising:

(a) a hollow cylinder;

(b) two discs of the same size, each disc having a hole in its center of like circumference to the hollow of the cylinder, one of each said discs connected to each end of and perpendicular to the cylinder, and said discs having a circumference larger than that of the cylinder and a diameter approximately equal to the length of the cylinder;

(c) means for attaching said peep sight to an archery bow string so that the cylinder is parallel to the bow string and the discs are perpendicular to the bow string, so that with the drawing of the bowstring the peep sight apparatus moves with the angle of the bowstring from a vertical position toward horizontal, which also causes the plane of the discs to move from a horizontal plane toward a vertical plane, thereby causing the peep sight to move into such a position that from the archer's line of sight the discs appear to overlap and visual notches usable as sighting apertures appear on either side of the overlapping discs.

2. An archery peep sight apparatus for mounting on the bowstring of an archery bow comprising a body made of a resilient material having a central, elongated, hollow cylinder; on each end of the cylinder a disc, each said disc having the same circumference as the other disc, which circumference is larger than that of the circumference of the cylinder and which diameter is approximately equal to the length of the cylinder, said discs joined concentrically with, and perpendicularly to, each end of the cylinder in such a manner that the flat surfaces of the two discs are perpendicular to the cylinder and the discs are approximately parallel to each other;

the discs also having at their centers a circular hole of a diameter approximately equal to the diameter of the hollow portion of the cylinder; which holes and hollow portion are also approximately equal to the diameter of the bowstring, which holes in the discs are aligned with the circular hollowness of the cylinder, said holes and hollow portion defining one hollow channel extending lengthwise through the center of the peep sight from end to end, thereby adapted to allow the bowstring of the bow to pass through the peep sight apparatus for mounting on the bowstring; so that, with the drawing of the bowstring the peep sight apparatus moves with the angle of the bowstring from a vertical position toward horizontal, which also causes the plane of the discs to move from a horizontal plane toward a vertical plane, thereby causing the peep sight to move into such a position that from the archer's line of sight the discs appear to overlap and visual notches usable as sighting apertures appear on either side of the visually overlapping discs; and means for securing said hollow cylinder portion around a bowstring above the nocking point in the bowstring.

3. Peep sight apparatus as recited in claim 2, wherein said means for mounting the peep sight apparatus onto the bowstring comprises a straight slot that extends through the radius of each disc parallel to the slot extending through the radius in the other disc, each said slot connecting to the hole in the center of each disc and connecting to a slot extending the length of the cylinder, said slot in said cylinder penetrating through the side of the cylinder into the hollow portion of the cylinder, thereby forming one long continuous slot through the side of the peep sight, which slot may be spread so as to allow the insertion of the bowstring through the slot and into the hollow center of the peep sight, so adapted that the bowstring might run lengthwise through the hollow center of the peep sight and extend out either end through the holes in the discs, whereby the mounting of the peep sight onto the bowstring may be accomplished while the bowstring is strung on an archery bow.

* * * * *